US009565950B2

(12) United States Patent
Horst et al.

(10) Patent No.: US 9,565,950 B2
(45) Date of Patent: Feb. 14, 2017

(54) INFANT CARE APPARATUS

(71) Applicant: Wonderland Nurserygoods Company Limited, Kwai Chung, N.T. (HK)

(72) Inventors: Andrew J. Horst, West Lawn, PA (US); Daniel A. Sack, Pottstown, PA (US); Ryan N. Miller, Lancaster, PA (US); Curtis M. Hartenstine, Birdsboro, PA (US); William B. Bellows, Wyomissing, PA (US)

(73) Assignee: Wonderland Nurserygoods Company, Ltd., Hong Kong (HK)

( * ) Notice: Subject to any disclaimer, the term of this patent is extended or adjusted under 35 U.S.C. 154(b) by 0 days.

(21) Appl. No.: 14/576,395

(22) Filed: Dec. 19, 2014

(65) Prior Publication Data

US 2015/0173523 A1 Jun. 25, 2015

Related U.S. Application Data

(60) Provisional application No. 61/963,990, filed on Dec. 20, 2013.

(51) Int. Cl.

| | |
|---|---|
| ***A47D 9/02*** | (2006.01) |
| ***A47D 7/01*** | (2006.01) |
| ***A47D 5/00*** | (2006.01) |
| ***A47D 9/04*** | (2006.01) |
| ***A47D 11/00*** | (2006.01) |

(52) U.S. Cl.

CPC . *A47D 7/01* (2013.01); *A47D 5/00* (2013.01); *A47D 9/04* (2013.01); *A47D 11/00* (2013.01)

(58) Field of Classification Search

CPC ..... A47D 9/02
USPC ..... 5/11, 101, 108–109
See application file for complete search history.

(56) References Cited

U.S. PATENT DOCUMENTS

| | | | | |
|---|---|---|---|---|
| 582,215 | A * | 5/1897 | Martin | 5/98.1 |
| 7,685,657 | B1 * | 3/2010 | Hernandez et al. | 5/109 |

* cited by examiner

*Primary Examiner* — Fredrick Conley
(74) *Attorney, Agent, or Firm* — Baker & McKenzie LLP

(57) ABSTRACT

An infant care apparatus includes a standing frame, and an infant resting support connected with the support frame and having a plurality of bearing surfaces. The infant resting support is rotatable relative to the standing frame to position any of the bearing surfaces facing upward for receiving a child thereon, and the infant resting support is further slidable vertically relative to the standing frame to adjust a height of the infant resting support.

25 Claims, 23 Drawing Sheets

100

INFANT CARE APPARATUS

CROSS-REFERENCE TO RELATED APPLICATION(S)

This application claims priority to U.S. Provisional Patent Application No. 61/963,990 filed on Dec. 20, 2013, which is incorporated herein by reference.

BACKGROUND

1. Field of the Invention

The present invention relates to infant care apparatuses.

2. Description of the Related Art

Currently, baby changer products typically include stationary changing tables, and play yards with a top mounted changer station. The stationary changing tables usually have a great storage in the form of shelves and/or drawers. However, owing to large and bulky dimensions, the stationary changing tables offer limited options for placement in a room.

Removable diaper changing stations may be purchased with a play yard as an add-on device. The primary use of the play yard is to provide an environment for sleeping a child, and the diaper changing station mounted on the top rail of the play yard is an added secondary device that has no convenient storage capabilities. In addition, like the stationary changing table, the play yard usually has no height adjustment and is large in dimensions, which may limit its placement amongst existing furniture.

Therefore, there is a need for an improved design that can be more flexible in use, and can address at least the foregoing issues.

SUMMARY

The present application describes an infant care apparatus that can offer convenience and flexibility in use. In one embodiment, the infant care apparatus includes a standing frame, and an infant resting support connected with the support frame and having a first and a second bearing surface opposite to each other. The infant resting support is rotatable relative to the standing frame to position either of the first and second bearing surface facing upward for receiving a child thereon, and the infant resting support is further slidable vertically relative to the standing frame to adjust a height of the infant resting support.

In another embodiment, the infant care apparatus includes a standing frame, an infant resting support, a latch mechanism and a release mechanism. The infant resting support is connected with the support frame and has a first and a second bearing surface opposite to each other, the infant resting support being rotatable relative to the standing frame to position either of the first and second bearing surface facing upward. The latch mechanism is configured to rotationally lock the infant resting support in a first or a second position with respect to the standing frame, the first bearing surface facing upward when the infant resting support is in the first position, and the second bearing surface facing upward when the infant resting support is in the second position. The release mechanism includes a release actuator operatively connected with the latch mechanism, wherein the release actuator is operable to slide in either of a first and a second direction opposite to each other to switch the latch mechanism from a locking state to an unlocking state.

DETAILED DESCRIPTION OF THE EMBODIMENTS

Figure 1:
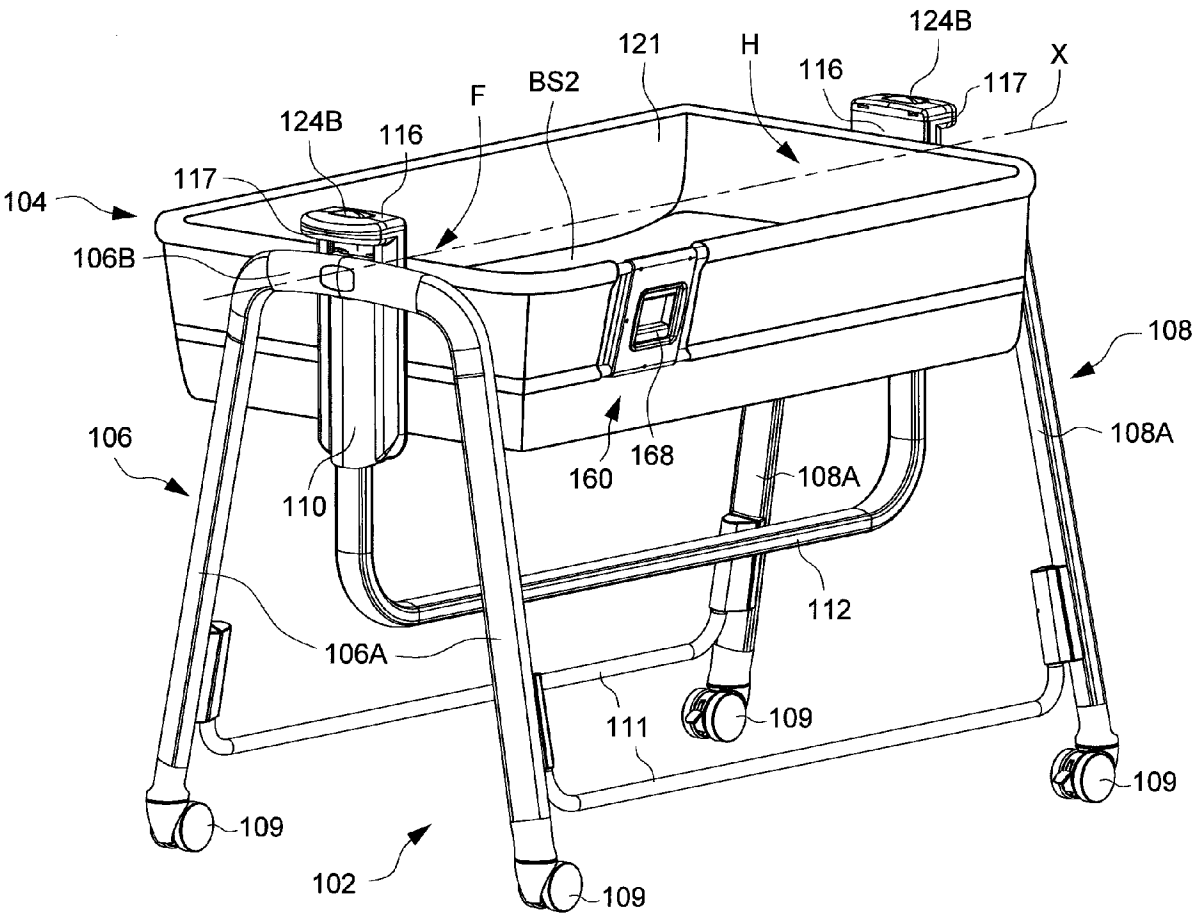
FIG. 1 is a perspective view illustrating one embodiment of an infant care apparatus.
Figure 2:
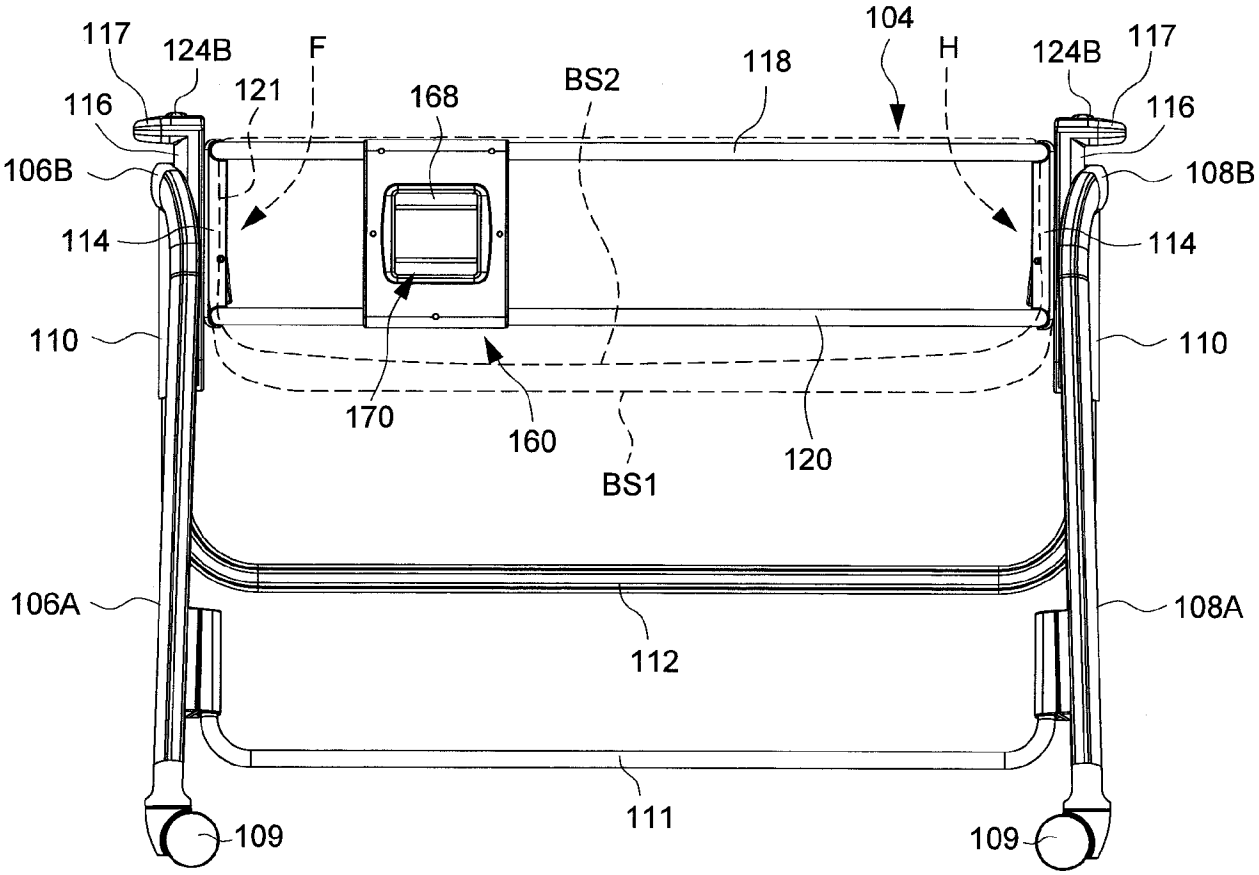
FIG. 2 is a side view illustrating a rigid frame structure of the infant care apparatus.

FIG. 1 is a perspective view illustrating one embodiment of an infant care apparatus 100, and FIG. 2 is a side view illustrating a rigid frame structure of the infant care apparatus 100 omitting a cloth and fabric envelope. The infant care apparatus 100 can include a standing frame 102, and an infant resting support 104 connected with the standing frame 102. The standing frame 102 alone is further shown in FIG. 3, and a rigid frame structure of the infant resting support 104 is shown in FIG. 4. The standing frame 102 can include two leg frames 106 and 108 disposed spaced apart from each other, and the infant resting support 104 can be disposed between the two leg frames 106 and 108. The leg frames 106 and 108 can be exemplary formed from the assembly of one or multiple tubes, and can have lower ends provided with wheel assemblies 109. With the wheel assemblies 109 rolling on a floor surface, the infant care apparatus 100 can easily move from one room to another room in a house.

The leg frame 106 can have two legs 106A that are connected with each other at an upper end portion 106B. The leg frame 108 can be disposed symmetrical and parallel to the leg frame 106, and can likewise have two legs 108A that are connected with each other at an upper end portion 108B. The connection between the leg frame 106 and the infant resting support 104 can be arranged near a foot area F of the infant resting support 104 (i.e., where the feet of a child can be placed), and the connection between the leg frame 108 and the infant resting support 104 can be arranged near a head area H of the infant resting support 104 (i.e., where the head of the child can be placed). It will be readily understood that the positions of the leg frames 106 and 108 can be interchanged, i.e., the leg frame 106 can be connected near the head area and the leg frame 108 near the foot area. Moreover, support bars 111 can be respectively affixed between the legs 106A and 108A to as to provide support for a storage basket (not shown) below the infant resting support 104.

Each of the leg frames 106 and 108 can be respectively affixed with a bracket 110. The bracket 110 can be formed, e.g., as a tubular segment, and can have an elongated shape extending generally vertical. The two brackets 110 can be respectively affixed with the upper end portions 106B and 108B of the two leg frames 106 and 108, and can respectively extend downward in two regions respectively between the two legs 106A and between the two legs 108A. A bar linkage 112 of a U-shape can be respectively affixed with the lower side of the two brackets 110, and extend between the two leg frames 106 and 108. In one embodiment, the bar linkage 112 can include two tubular segments that are respectively affixed in the two brackets 110.

The infant resting support 104 can be affixed with two rotary hubs 114 that are respectively connected with the two brackets 110 via two adjusting members 116. Each of the two adjusting members 116 can be formed as a housing with a hollow structure, and can have an elongated shape. The two adjusting members 116 can be respectively connected slidably with the two brackets 110 for vertical displacement, e.g., through a telescopic arrangement. The two rotary hubs 114 can be respectively arranged near the foot and head areas of the infant resting support 104, and can be connected pivotally with the two adjusting members 116 about a pivot axis X that extends along a lengthwise axis from the foot area to the head area of the infant resting support 104. Through the aforementioned assembly, the infant resting support 104 and the rotary hubs 114 affixed therewith can slide vertically along the brackets 110 relative to the standing frame 102, and can also rotate about the pivot axis X relative to the brackets 110 of the standing frame 102. For facilitating the vertical adjustment of the infant resting support 104, each adjusting member 116 may further have a grip portion 117 that is easy to grasp. A caregiver thus can directly grasp the two adjusting members 116 with two hands, and then lift or lower the infant resting support 104 as desired.

Referring to FIGS. 2 and 4, the infant resting support 104 can include two rigid frame portions 118 and 120 arranged parallel and offset with respect to each other. Each of the frame portions 118 and 120 can have a similar closed shape formed by the assembly of one or more tubular segments. A cloth material 121 can be wrapped around the frame portions 118 and 120 so as to define an outer envelope of the infant resting support 104, which can be provided with two opposite bearing surfaces BS1 and BS2 (shown with solid lines in FIG. 1 and phantom lines in FIGS. 2 and 4) respectively adapted to receive the placement of a child. The first and second bearing surfaces BS1 and BS2 can be configured to provide different functions. For example, when it is turned upward, the first bearing surface BS1 can be configured as a changer table having a relative flat and stiffer bearing surface. In contrast, the second bearing surface BS2 when facing upward can be configured as a bed or bassinet having a curved, softer bearing surface to provide comfortable sleeping support for a child.

The aforementioned frame connections allow at least two degrees of adjustment for the infant resting support 104: the infant resting support 104 can be vertically slidable relative to the standing frame 102 to adjust its height from a floor surface, and the infant resting support 104 is further rotatable about the pivot axis X relative to the standing frame 102 so that either of the first and second bearing surface BS1 and BS2 can be positioned to face upward for receiving a child thereon.

Figure 3:
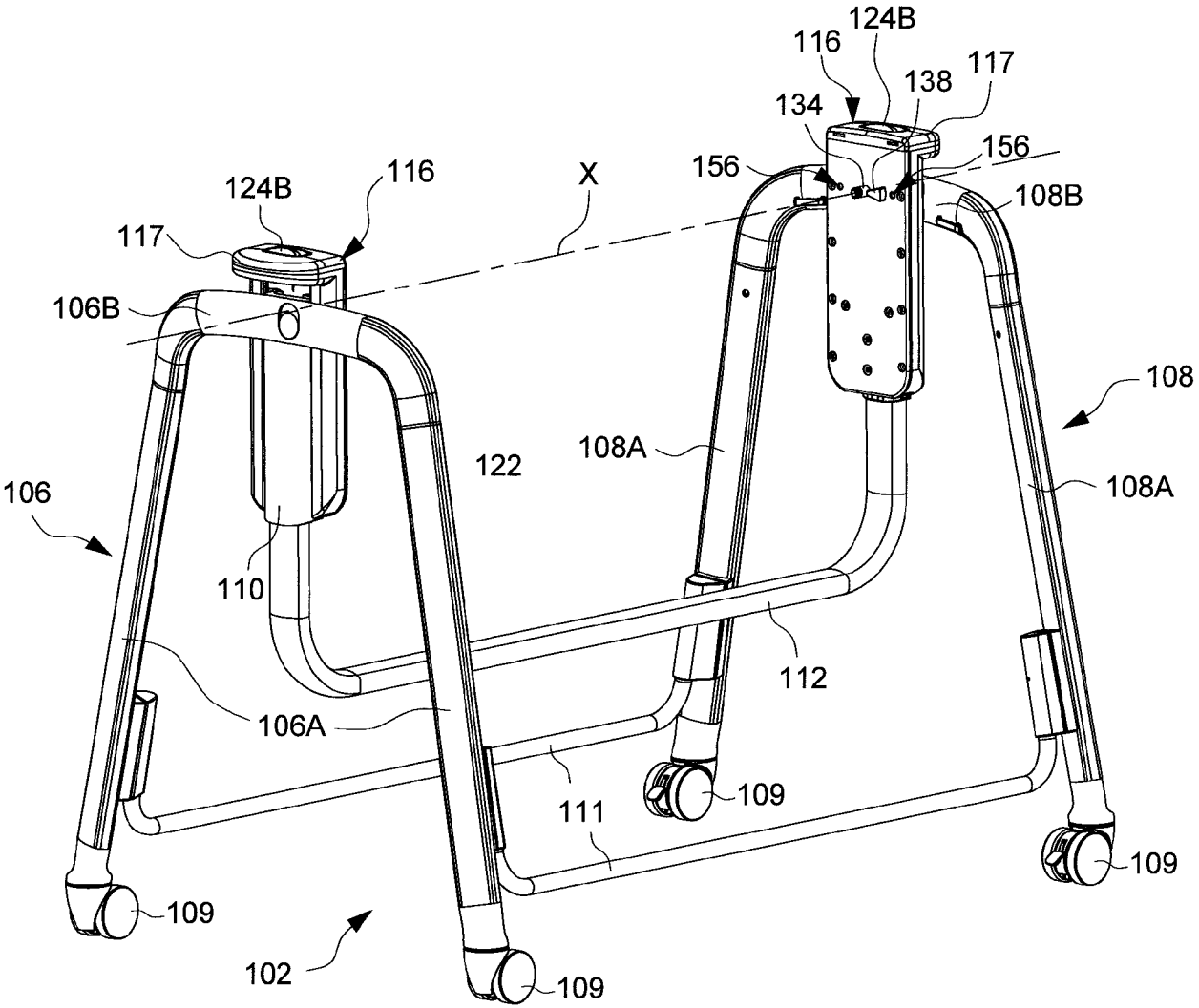
FIG. 3 is a schematic view illustrating a standing frame of the infant care apparatus.
Figure 4:
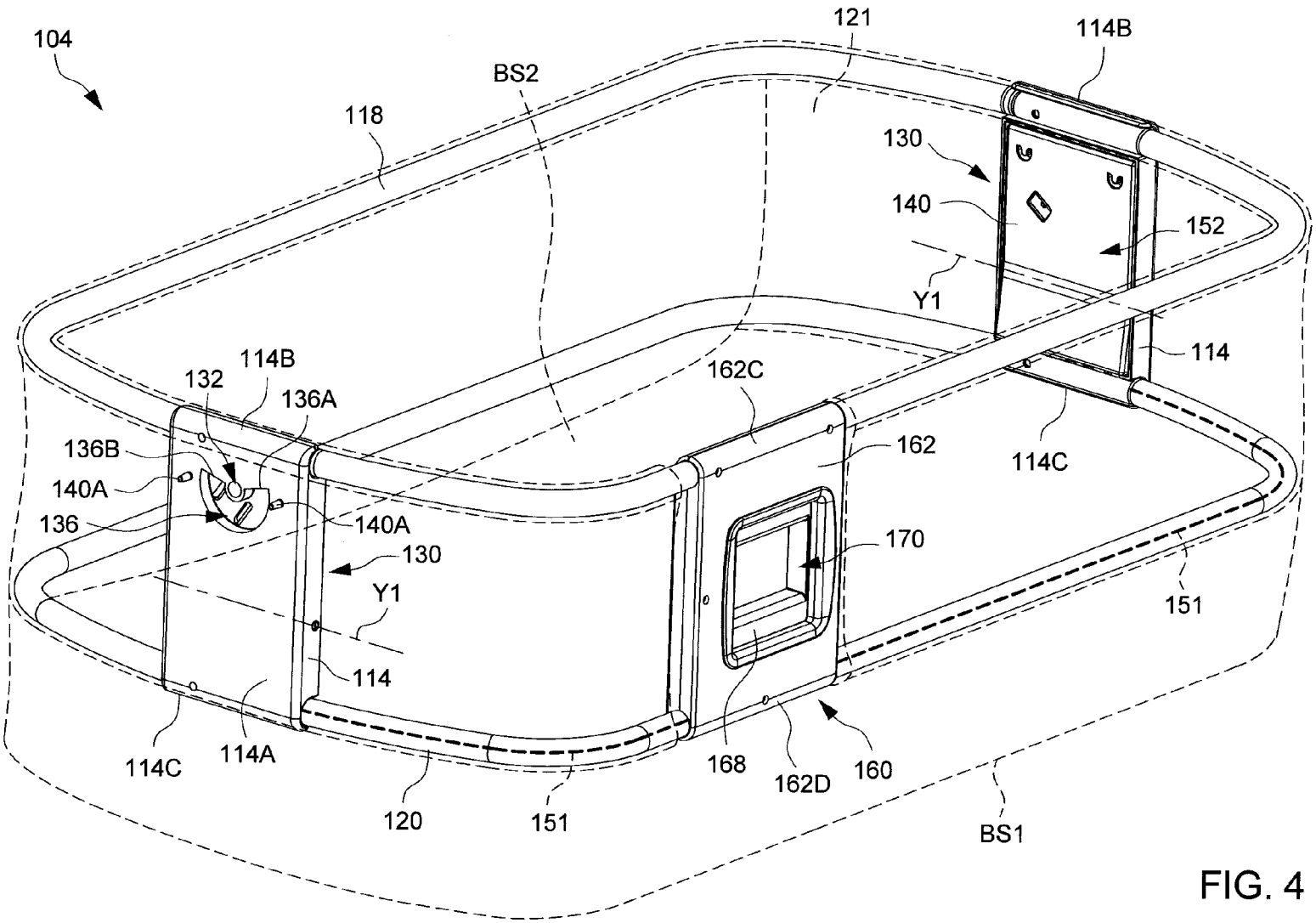
FIG. 4 is a schematic view illustrating a rigid frame structure of an infant resting support provided in the infant care apparatus.
Figure 5:
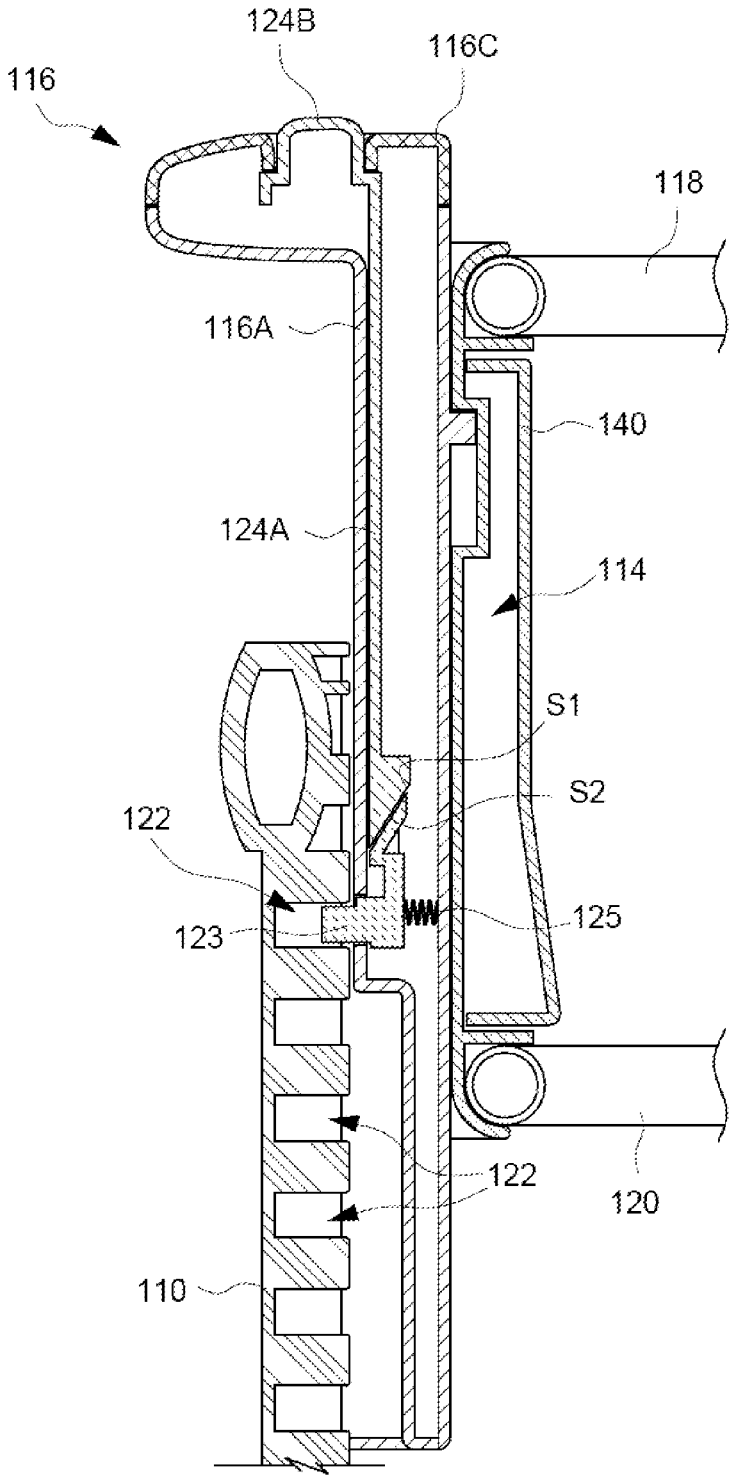
FIG. 5 is a schematic cross-sectional view illustrating a vertical lock mechanism operable to lock a vertical position of the infant resting support in the infant care apparatus.
Figure 6:
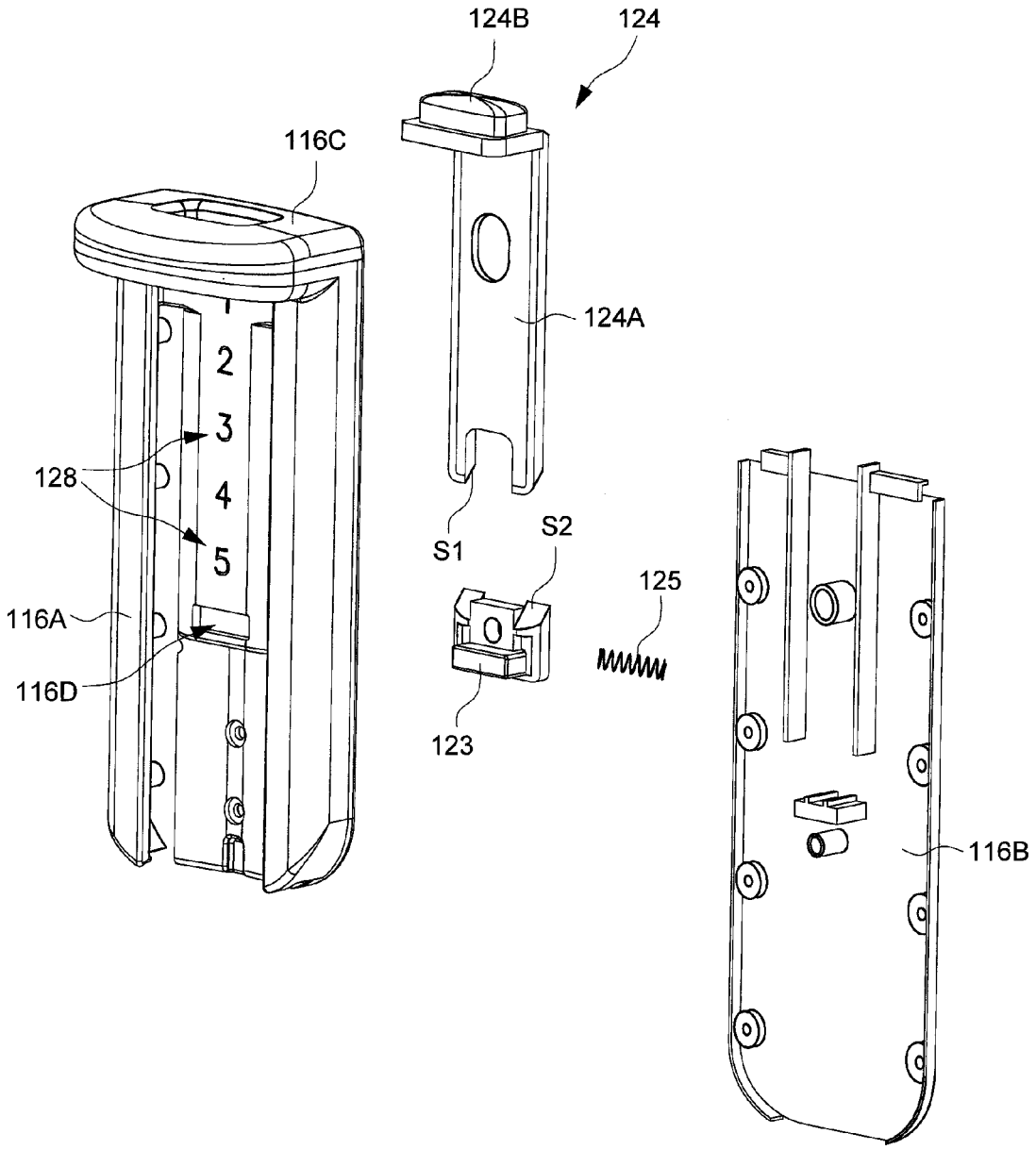
FIG. 6 is an exploded view illustrating the assembly of a latch and a release member used in the vertical lock mechanism shown in FIG. 5.

In conjunction with FIG. 3, FIGS. 5 and 6 are schematic views illustrating the construction of a vertical lock mechanism operable to respectively lock each adjusting member 116 with the corresponding bracket 110 for securely holding the infant resting support 104 at a desirable vertical position. For implementing the vertical lock mechanism, each of the brackets 110 can include a row of openings 122, and each of the adjusting members 116 can include a latch 123 and a release member 124 operatively connected with each other, and a spring 125 for biasing the latch 123 to a locking state. As shown in FIG. 5, the openings 122 can be arranged on an inner sidewall of the bracket 110. The adjusting member 116 can include a housing 116A that is respectively affixed with a board 116B and a top cover 116C. The latch 123 can be movably assembled with the board 116B of the adjusting member 116, and can protrude outside the adjusting member 116 via an opening 116D formed through the housing 116A. The spring 125 can be respectively connected with the latch 123 and the board 116B. The latch 123 can be biased by the spring 125 to engage with any of the openings 122 to lock the adjusting member 116 with the bracket 110, thereby vertically locking the infant resting support 104 with respect to the standing frame 102.

The release member 124 can be operable to switch the latch 123 from the locking state to an unlocking state. The release member 124 is slidably assembled with the adjusting member 116. The release member 124 can be formed to include a stem 124A extending generally vertical in the housing 116A, and a button portion 124B exposed at a top of the adjusting member 116 for operation. A lower end portion of the stem 124A can have a ramp surface S1 that is in sliding contact with a corresponding ramp surface S2 provided on the latch 123. When the button portion 124B is depressed, the stem 124A can slide downward, which urges the latch 123 to disengage from the openings 122 owing to the sliding contact between the ramp surfaces S1 and S2 of the stem 124A and the latch 123. To facilitate operation of the release member 124, the button portion 124B may be arranged near the grip portion 117 of the adjusting member 116.

For vertically adjusting the infant resting support 104, the two release members 124 are operated at the same time to respectively unlock the adjusting members 116 from the brackets 110. The infant resting support 104 then can be vertically adjusted relative to the standing frame 102, the two adjusting members 116 moving vertically with the infant resting support 104 relative to the brackets 110. A plurality of markings 128 may be provided on the adjusting members 116 to visually indicate the different vertical positions that can be occupied by the infant resting support 104. Once the infant resting support 104 reaches a desired height, the latches 123 in the two adjusting members 116 can respectively engage with the corresponding openings 122 by the spring action to lock the adjusting members 116 with the brackets 110. The infant resting support 104 can be thereby vertically locked in position.

Figure 7:
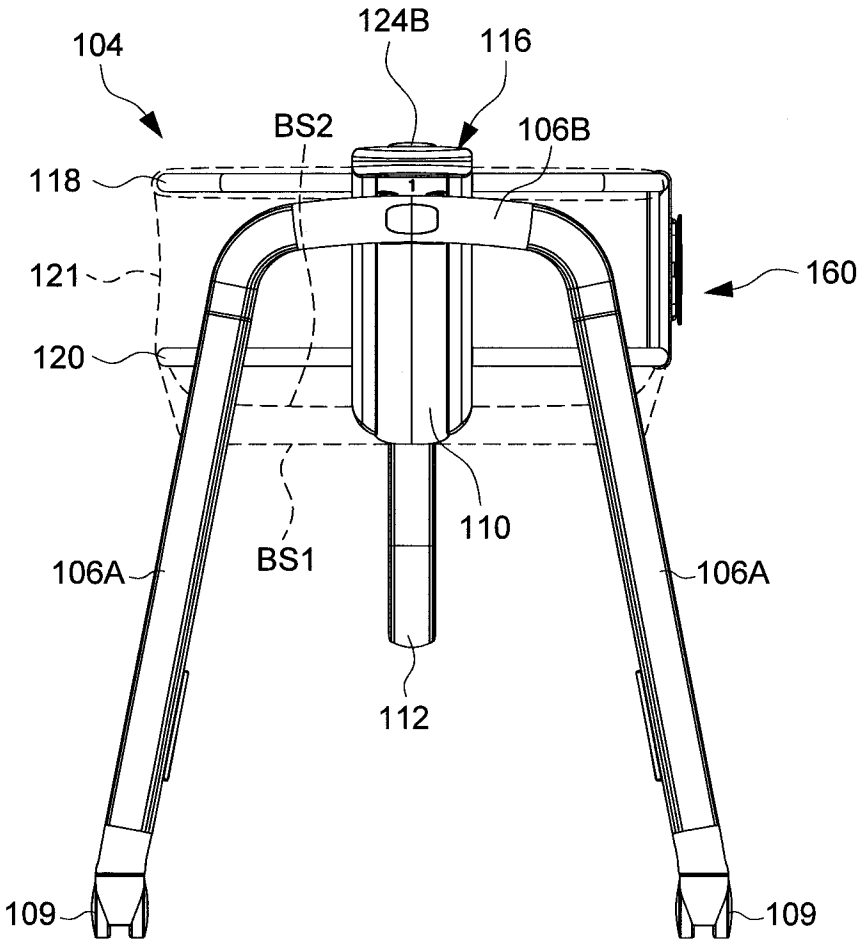
FIGS. 7 and 8 are schematic views illustrating two examples of different vertical positions that may be occupied by the infant resting support when it is in a bassinet configuration.
Figure 8:
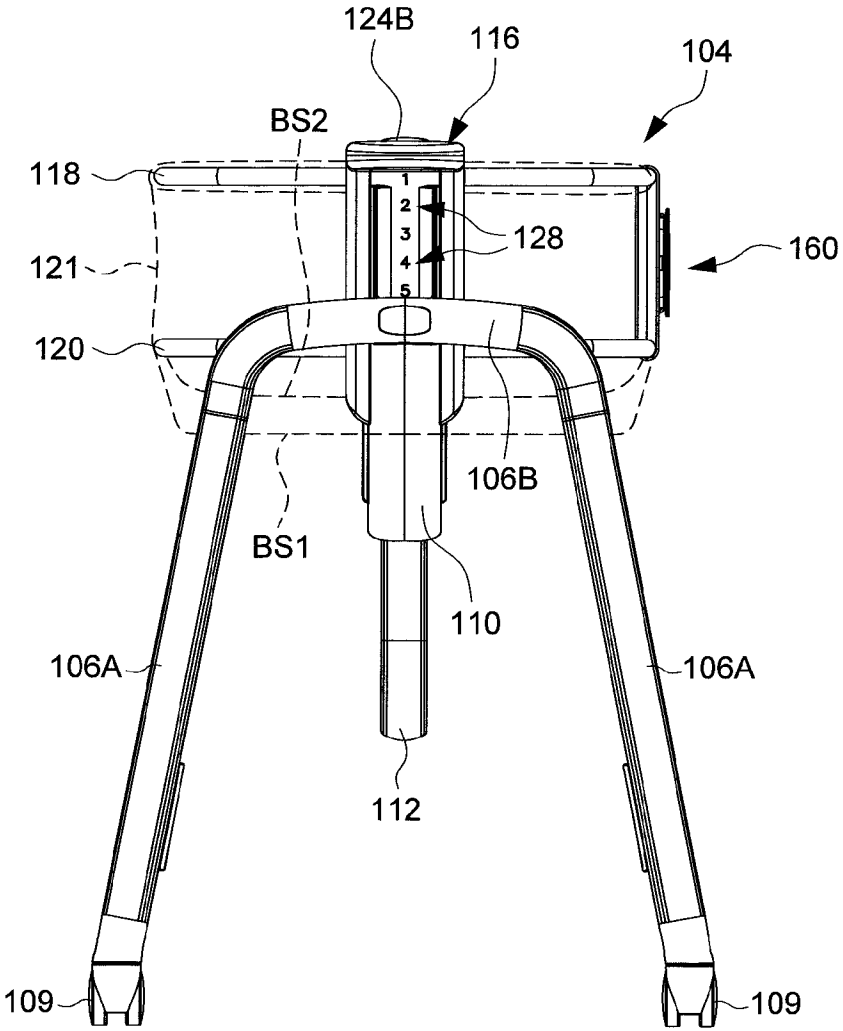
Figure 9:
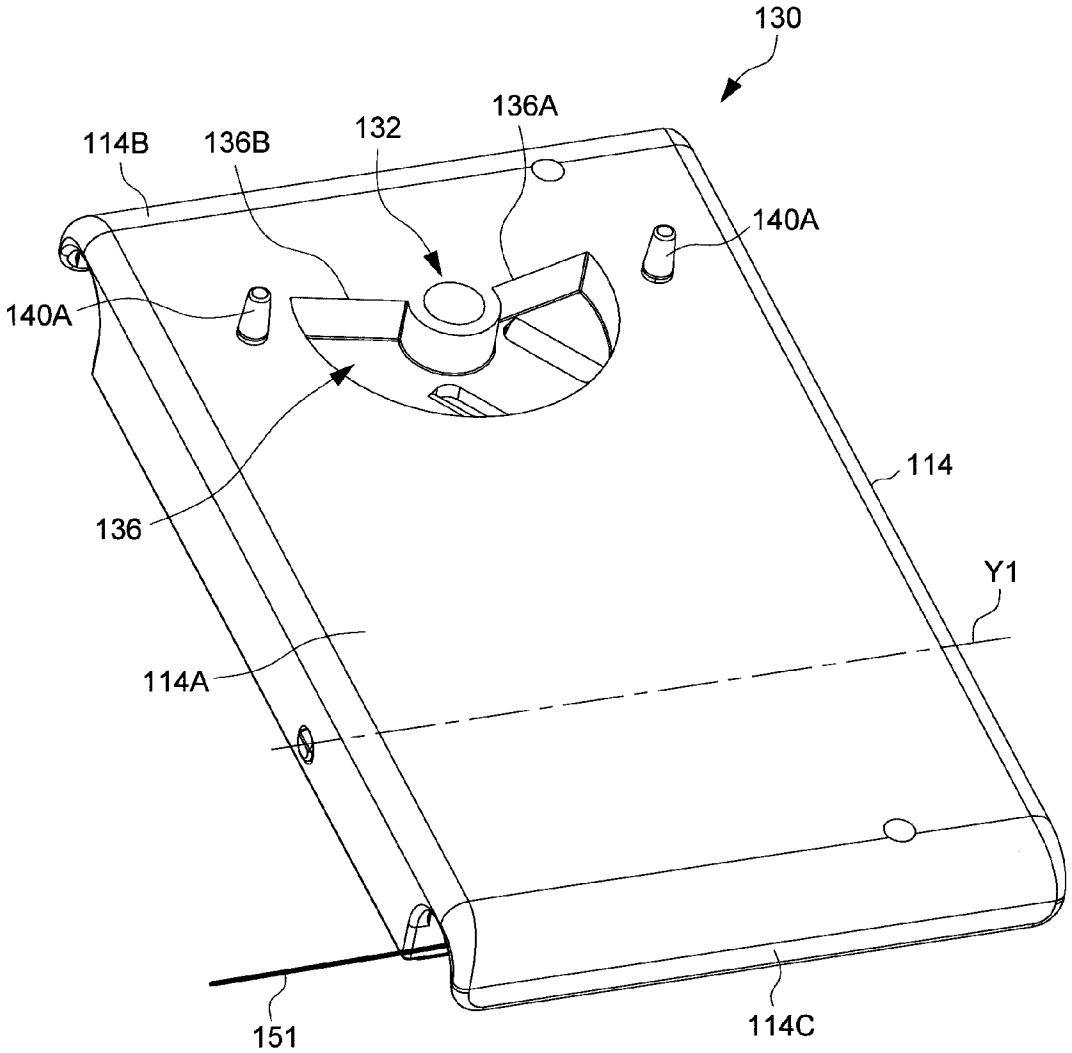
FIG. 9 is a schematic view illustrating a rotary hub of the infant resting support provided with a latch mechanism for rotationally locking the infant resting support.
Figure 10:
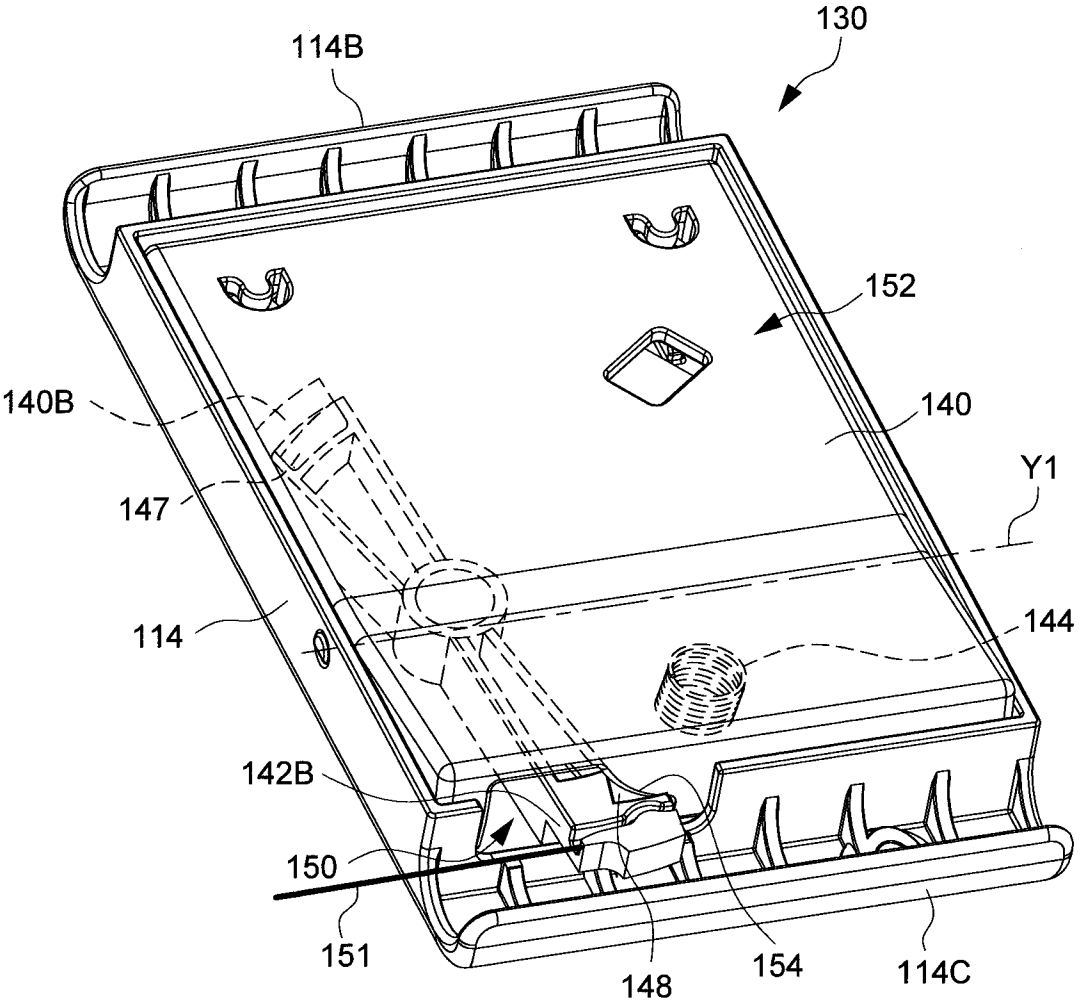
FIG. 10 is a schematic view illustrating the rotary hub provided with the latch mechanism under a different angle of view.
Figure 11:
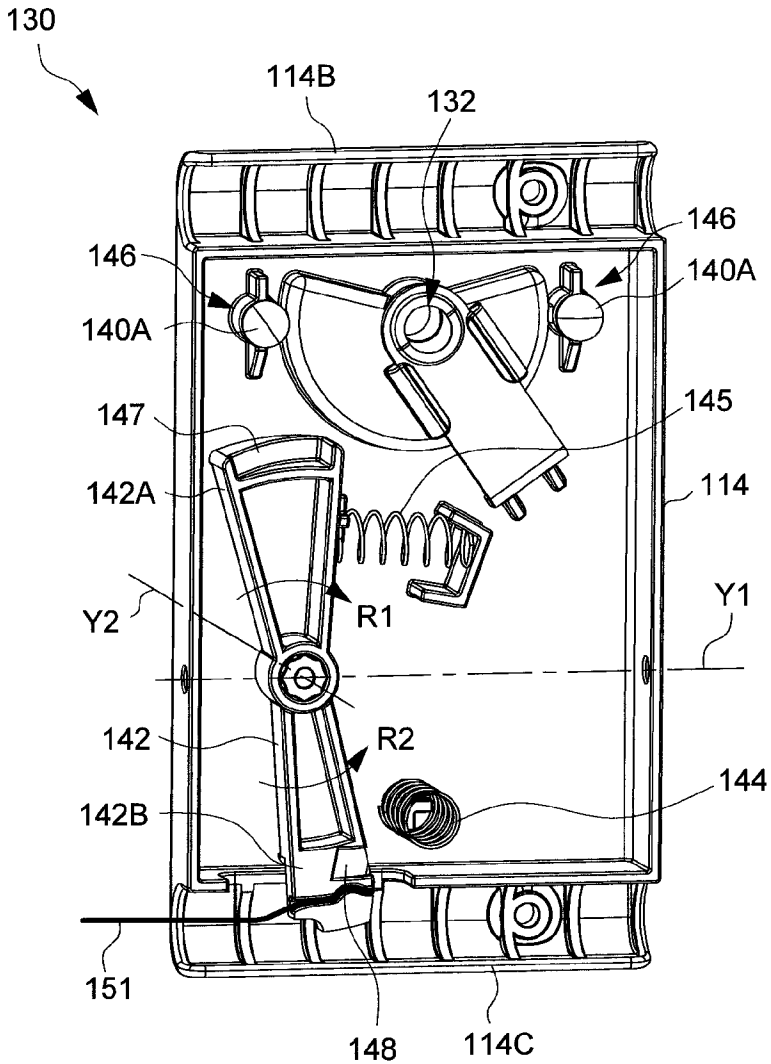
FIG. 11 is a schematic view illustrating the construction of the latch mechanism in the rotary hub.
Figure 12:
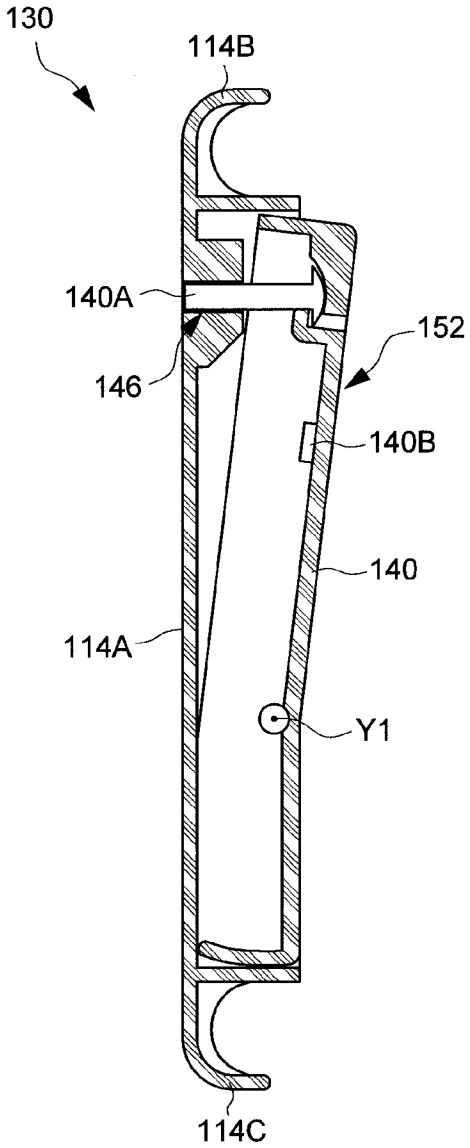
FIG. 12 is a cross-sectional view illustrating the assembly of a latch in the rotary hub.

With the aforementioned structure, each of the two configurations of use of the infant resting support 104 (e.g., a changer configuration with the bearing surface BS1 facing upward and bassinet configuration with the bearing surface BS2 facing upward) can be adjustable to different vertical positions near the upper end portions 106B and 108B of the standing frame 102. FIGS. 7 and 8 are schematic views illustrating two examples of different vertical positions that may be occupied by the infant resting support 104 when it is in the bassinet configuration. The infant resting support 104 is at a lowest position in FIG. 7, and a highest position in FIG. 8.

In conjunction with FIGS. 1-4, reference is further made to FIGS. 9-12 to describe the pivotal connections between the two rotary hubs 114 and the adjusting members 116, and two latch mechanisms 130 for rotationally locking the infant resting support 104 with respect to the standing frame 102. The two rotary hubs 114 are disposed at two opposite sides of the infant resting support 104. Each of the rotary hubs 114 can be formed as a housing having a front surface 114A. The rotary hub 114 can further have two opposite sleeve portions 114B and 114C that can respectively affix with the two frame portions 118 and 120. A hole 132 can be formed through the front surface 114A at a location between the two frame portions 118 and 120, and the corresponding adjusting member 116 can have a shaft 134 that is assembled through the hole 132 to pivotally connect the rotary hub 114 with the adjusting member 116 about the pivot axis X. A window 136 can be further cut in the front surface 114A of the rotary hub 114 centered on the axis of the hole 132. When the rotary hub 114 is pivotally connected with the adjusting member 116, a stop rib 138 affixed with the adjusting member 116 can be received in the window 136. The stop rib 138 can abut against any of two opposite edges 136A and 136B of the window 136 to delimit a rotational range of the infant resting support 104 equal to 180 degrees.

The two latch mechanisms 130 can be respectively assembled with the two rotary hubs 114, and are operable independently from the latches 123 of the vertical lock mechanisms. In one embodiment, the two latches mechanisms 130 can be similar in construction. Each latch mechanism 130 can include a hub cover 140 affixed with two spaced-apart locking projections 140A, a rocker 142 and springs 144 and 145. The hub cover 140 is pivotally connected with the rotary hub 114 about a pivot axis Y1, and can be arranged behind the front surface 114A to close at least partially a rear of the rotary hub 114. The two locking projections 140A can be pins affixed with the hub cover 140, or protrusions formed integral with the hub cover 140. The two locking projections 140A can respectively pass through two holes 146 formed through the front surface 114A of the rotary hub 114 toward the adjusting member 116.

The spring 144 is respectively connected with the rotary hub 114 and the hub cover 140, and can rotationally bias the hub cover 140 to cause the locking projections 140A to extend outward on the front surface 114A to effect a locking engagement with the adjusting member 116.

The rocker 142 is arranged in the rotary hub 114, and is covered with the hub cover 140. The rocker 142 can be pivotally with the rotary hub 114 about a pivot axis Y2 that is substantially parallel to the pivot axis X of the infant resting support 104. The pivot axis Y2 is also substantially orthogonal to the pivot axis Y1 of the hub cover 140 and perpendicular to the front surface 114A. The rocker 142 can have a first end portion 142A formed with a driving surface 147 (e.g., a ramp surface) that is offset to one side of the pivot axis Y1, and a second end portion 142B formed with a stop surface 148 offset to another side of the pivot axis Y1 opposite to that of the driving surface 147. An inner sidewall of the hub cover 140 can be formed with a rib 140B (shown with phantom lines in FIG. 10) projecting inward, and the driving surface 147 can be in sliding contact with the rib 140B at a location eccentric from the pivot axis Y1. The first end portion 142A is also connected with an end of the spring 145, and the other end of the spring 145 is anchored with the rotary hub 114. At the other side of the pivot axis Y1, the second end portion 142B of the rocker 142 can extend outside the hub cover 140 through an opening 150 formed through the hub cover 140 so as to be adjacent to the frame portion 118. A cable 151 can have an end anchored with the second end portion 142B of the rocker 142.

The hub cover 140 and the locking projections 140A as described previously can form a latch 152 that can be biased by the spring 144 to a locking state for rotationally locking the infant resting support 104, and the rocker 142 can be pulled in rotation by the cable 151 to drive an unlocking displacement of the latch 152. More specifically, owing to the sliding contact between the driving surface 147 and the hub cover 140, the rocker 142 can rotate in a direction R1 to drive an unlocking rotation of the latch 152 against the spring force of the spring 144. The rotation of the rocker 142 in the direction R1 can also compress the spring 145 and disengage the stop surface 148 from a counterpart surface 154 of the hub cover 140. The counterpart surface 154 can be exemplary formed on a rim of the opening 150.

When the pulling action applied by the cable 151 is released, the spring 144 can bias the latch 152 to the locking state engaging with the openings 156 provided on the adjusting member 116. The latch 152 can engage with the same openings 156 to lock the infant resting support 104 in a first position where the first bearing surface BS1 faces upward, and in a second position where the bearing surface BS2 faces upward. While the latch 152 is switched to the locking state, the spring 145 can bias the rocker 142 in a direction R2 opposite to the direction R1 to a blocking position where the stop surface 148 is in engaging contact with the counterpart surface 154 of the hub cover 140. The engagement of the stop surface 148 with the counterpart surface 154 is arranged at a side of the pivot axis Y1 that is opposite to that of the contact between the driving surface 147 and the hub cover 140, and can prevent displacement of the latch 152 from the locking state to the unlocking state. Accordingly, accidental pressure on the hub cover 140 would not be able to drive an unlocking displacement of the latch 152. It will be appreciated that other arrangements of the driving surface 147 on the rocker 142 may be possible to drive an unlocking rotation of the latch 152. For example, the tilt/orientation of the driving surface 147 may be changed and the driving surface 147 may be placed at the same side as the stop surface 148 with respect to the pivot axis Y1 to achieve a similar unlocking rotation of the latch 152.

Figure 13:
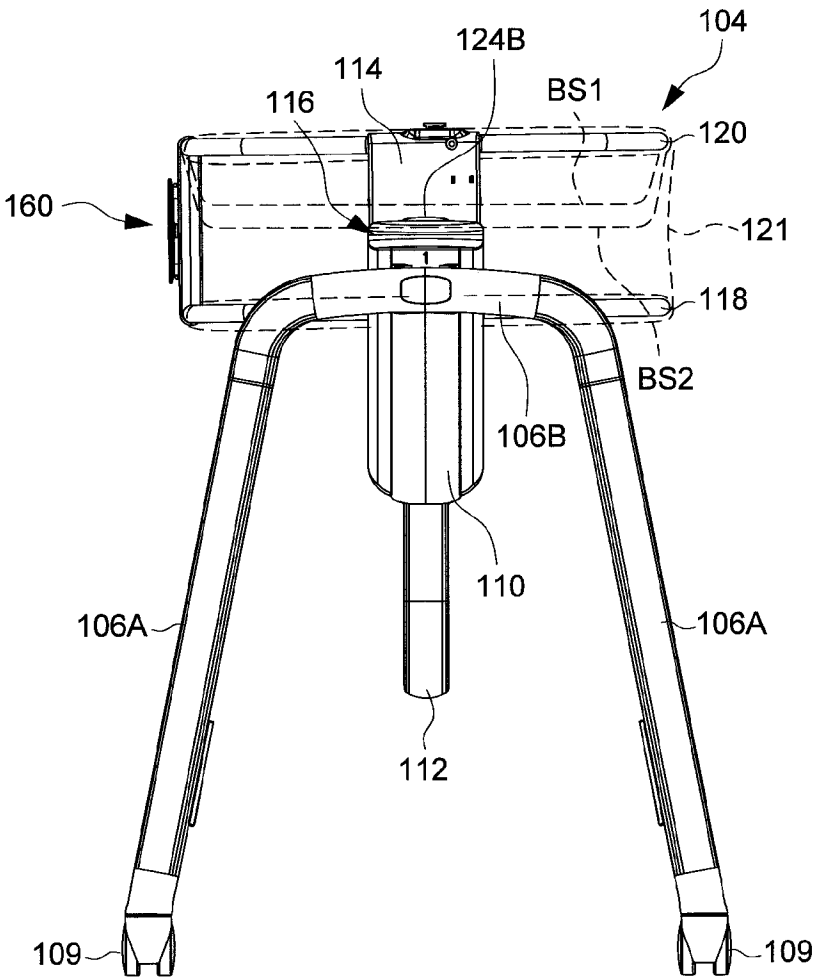
FIG. 13 is a schematic view illustrating the infant resting support rotationally locked in a position corresponding to a changer configuration.
Figure 14:
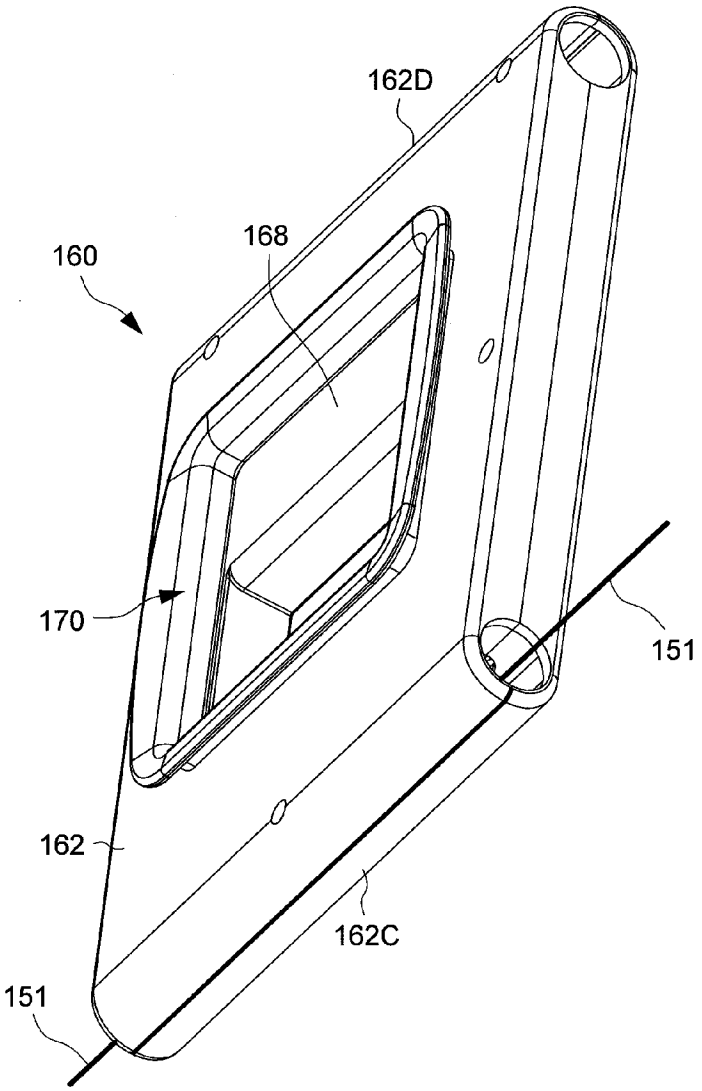
FIG. 14 is a schematic view illustrating a release mechanism provided on the infant resting support.
Figure 15:
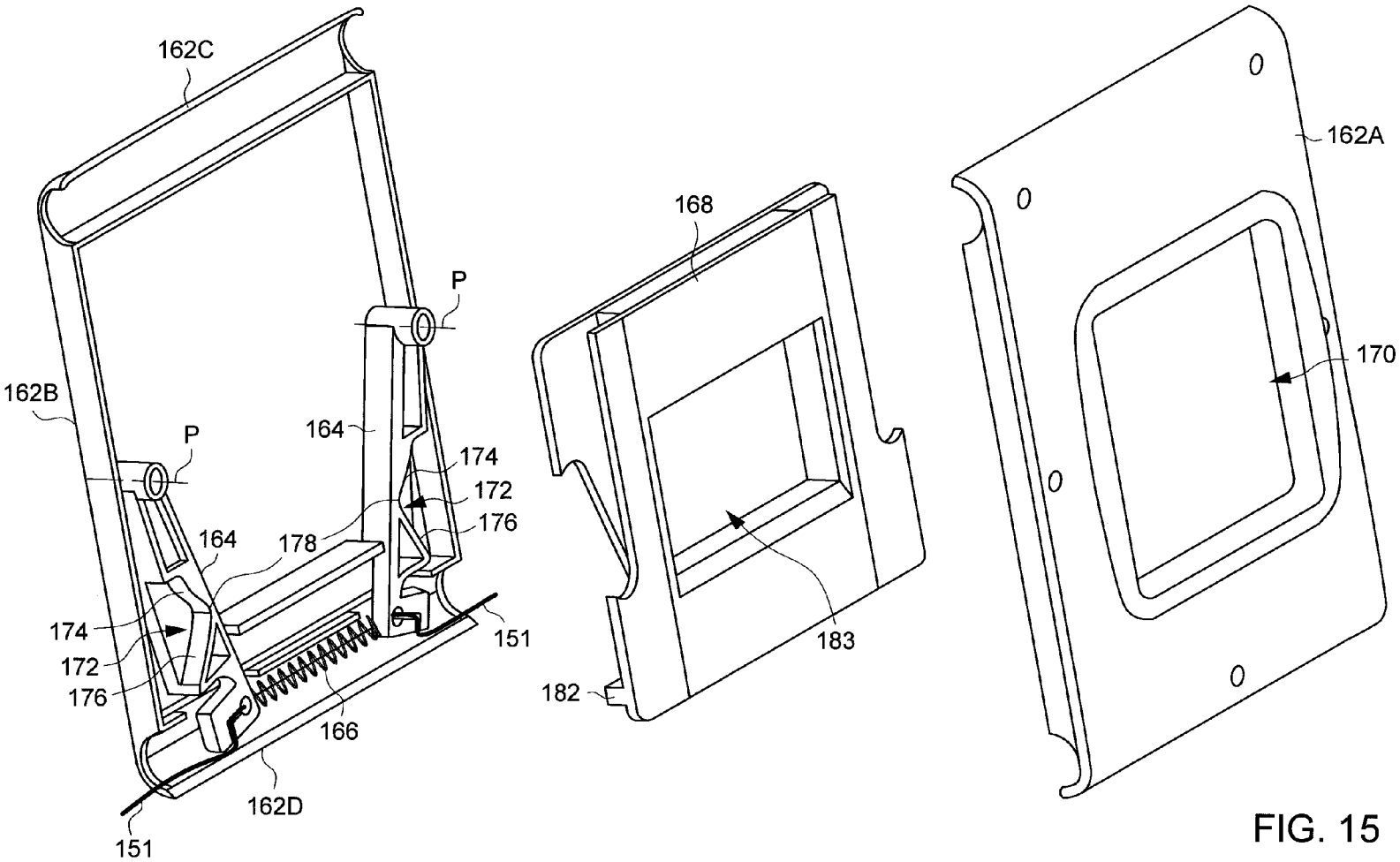
FIG. 15 is an exploded view illustrating the release mechanism shown in FIG. 12.

The two latch mechanisms 130 can have a same construction as described previously, and can rotationally lock the infant resting support 104 in two positions. FIGS. 2 and 7 illustrate the infant resting support 104 locked in a position corresponding to a bassinet configuration (i.e., with the bearing surface BS2 facing upward), and FIG. 13 illustrates the infant resting support 104 locked in another position corresponding to a changer configuration (i.e., with the bearing surface BS1 shown in FIG. 2 facing upward).

In conjunction with FIGS. 1, 2 and 4, FIGS. 14-18 are schematic views illustrating the construction and operation of a release mechanism 160 provided on the infant resting support 104. The release mechanism 160 can be operable to switch the latches 152 of the two latch mechanisms 130 from the locking state to the unlocking state. The release mechanism 160 can be operatively connected with the two latch mechanisms 130 (i.e., the rockers 142) via two cables 151. The release mechanism 160 can include a housing 162 in which are assembled two release rockers 164, a spring 166 and a release actuator 168. The assembly of the housing 162, release rockers 164, spring 166 and release actuator 168 can be disposed at a side of the infant resting support 104 offset from the pivot axis X. The housing 162 can be formed by the assembly of two housing bodies 162A and 162B, and can have two opposite sleeve portions 162C and 162D that are respectively affixed with the two frame portions 118 and 120 of the infant resting support 104. The housing 162 can be arranged so that a front surface thereof oriented outward has an opening 170.

The two release rockers 164 can be arranged symmetrically at two opposite sides of the opening 170, and can be pivotally connected with the housing 162 about two pivot axes P parallel to each other. Each of the release rockers 164 can have a recess 172 that is offset from the pivot axis of the release rocker 164. The recess 172 can be delimited at least partially by two ramp surfaces 174 and 176. The two ramp surfaces 174 and 176 can be connected with each other at a joint region 178, and can be inclined to two opposite sides of a horizontal direction passing through the joint region 178 so as to face each other across the recess 172. The two sets of the ramp surfaces 174 and 176 can be symmetrical to each other on the two release rockers 164. A distal end portion 180 of the release rocker 164 can be arranged adjacent to the frame portion 118, and can be anchored with an end of one cable 151. Each cable 151 can thus have two opposite ends respectively connected with the release rocker 164 of the release mechanism 160 and the rocker 142 of one latch mechanism 130.

The spring 166 can have two opposite ends respectively connected with the two release rockers 164. The spring 166 can rotationally bias the two release rockers 164 away from each other.

The release actuator 168 can be slidably assembled with the housing 162, and can be positioned across a region between the two release rockers 164. The release actuator 168 can slide in either direction along an axis of displacement T that is substantially orthogonal to the pivot axes of the two release rockers 164, and can be exposed at least partially at the opening 170 for operation. Moreover, the release actuator 168 is affixed with two symmetrical protrusions 182 that are respectively received in the recesses 172 of the two release rockers 164. Each of the protrusions 182 can be in sliding contact with the corresponding release rocker 164 along a path formed by the ramp surfaces 174 and 176. The sliding contact between the release actuator 168 and the two release rockers 164 can be maintained by the biasing action of the spring 166. For facilitating manual operation, the release actuator 168 can further include a central opening 183 through which a caregiver can manually grip and actuate the release actuator 168.

Figure 16:
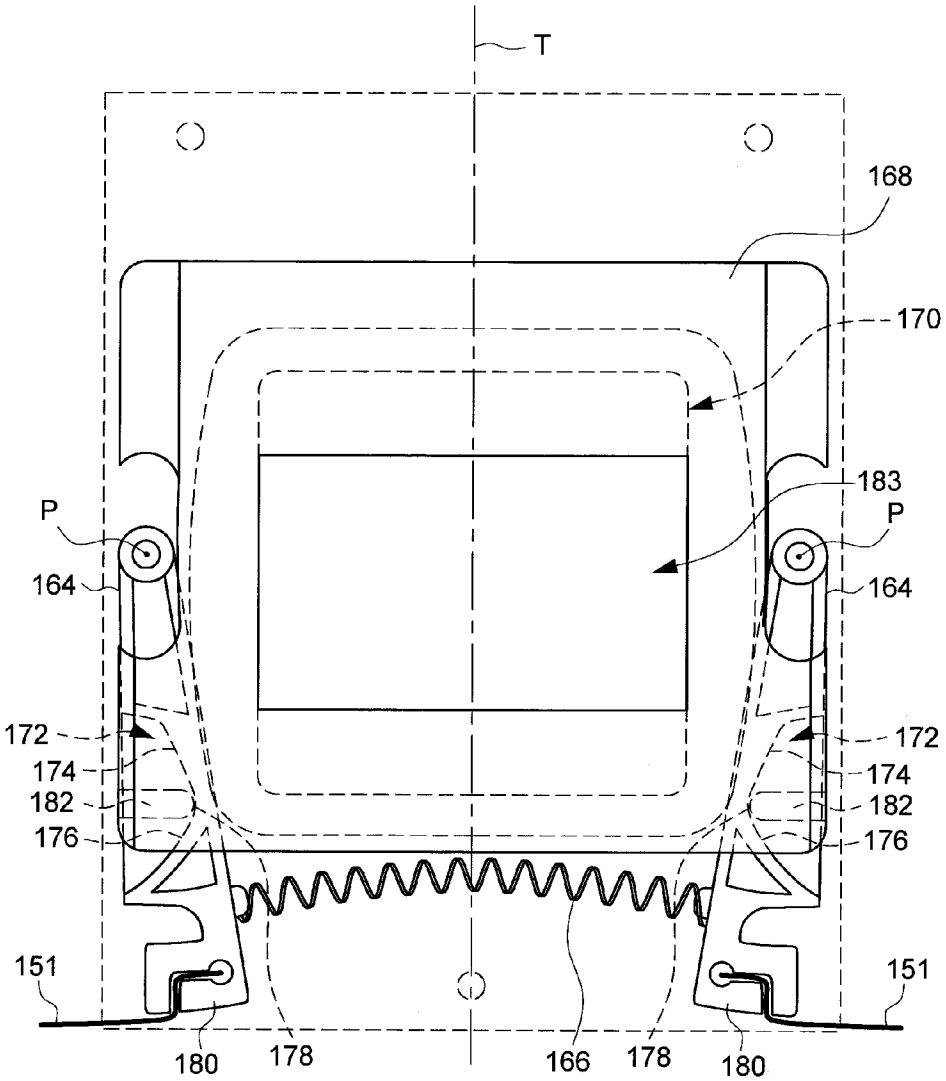
FIG. 16 is a schematic view illustrating the release mechanism in a rest position.

The release mechanism 160 as described previously can be operable to drive concurrent unlocking of the two latch mechanisms 130. More specifically, the release actuator 168 can have a stable rest position where the protrusions 182 are respectively adjacent to the joint regions 178 in the recesses 172 of the two release rockers 164. This rest position of the release actuator 168 is shown in FIG. 16.

Figure 17:
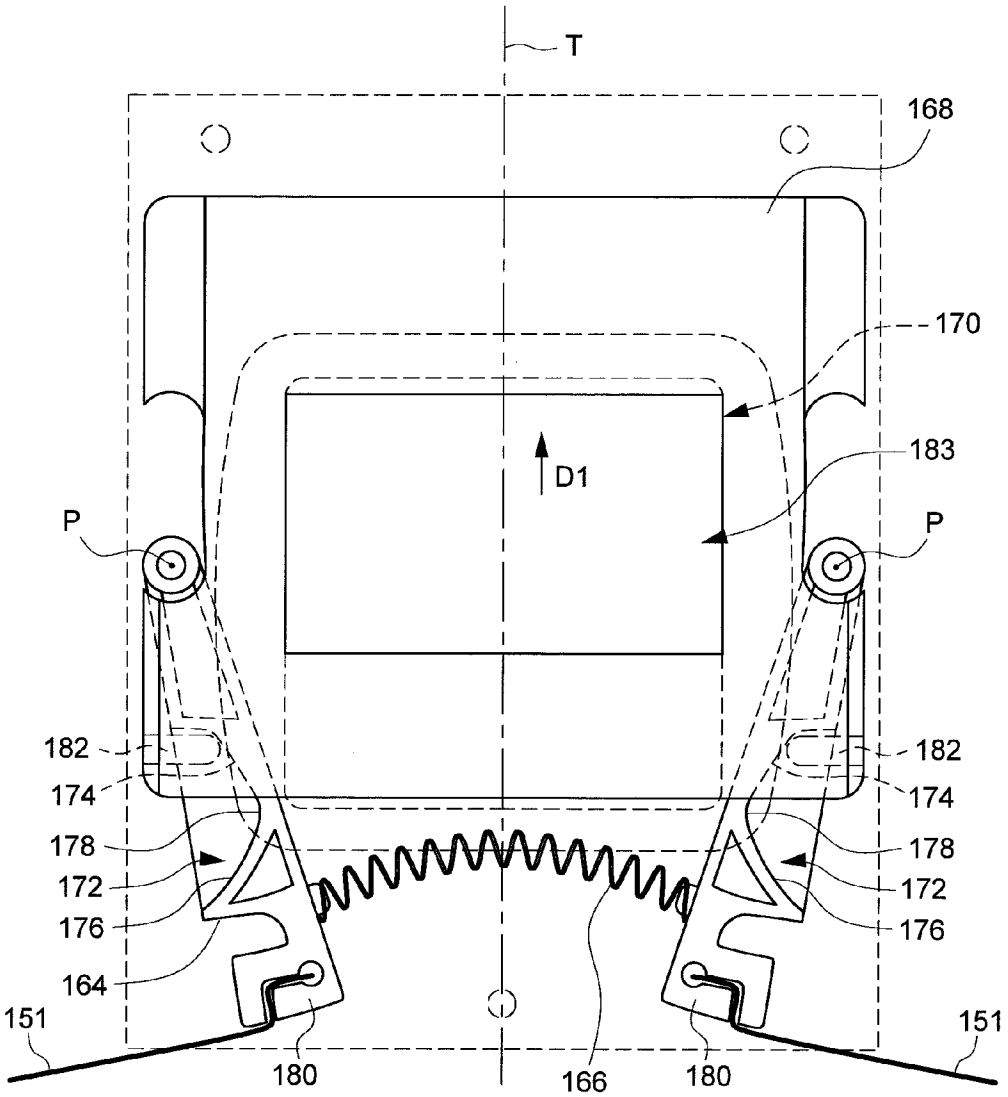
FIG. 17 is a schematic view illustrating the release mechanism operated in a first direction.

Referring to FIG. 17, when the release actuator 168 is actuated to slide in a first direction D1 (e.g., upward) away from the rest position, the two protrusions 182 can respectively slide in contact with the ramp surfaces 174 away from the joint regions 178, which can urge the two release rockers 164 to rotate toward each other and compress the spring 166. As a result, the release rockers 164 can respectively pull on the cables 151, which in turn respectively can pull the rockers 142 in rotation to drive unlocking displacements of the latches 152 in the two latch mechanisms 130 like described previously.

When the manual action applied on the release actuator 168 is released, the spring 166 can bias the two release rockers 164 to rotate away from each other, and the release actuator 168 can recover the rest position with the protrusions 182 adjacent to the joint regions 178.

Figure 18:
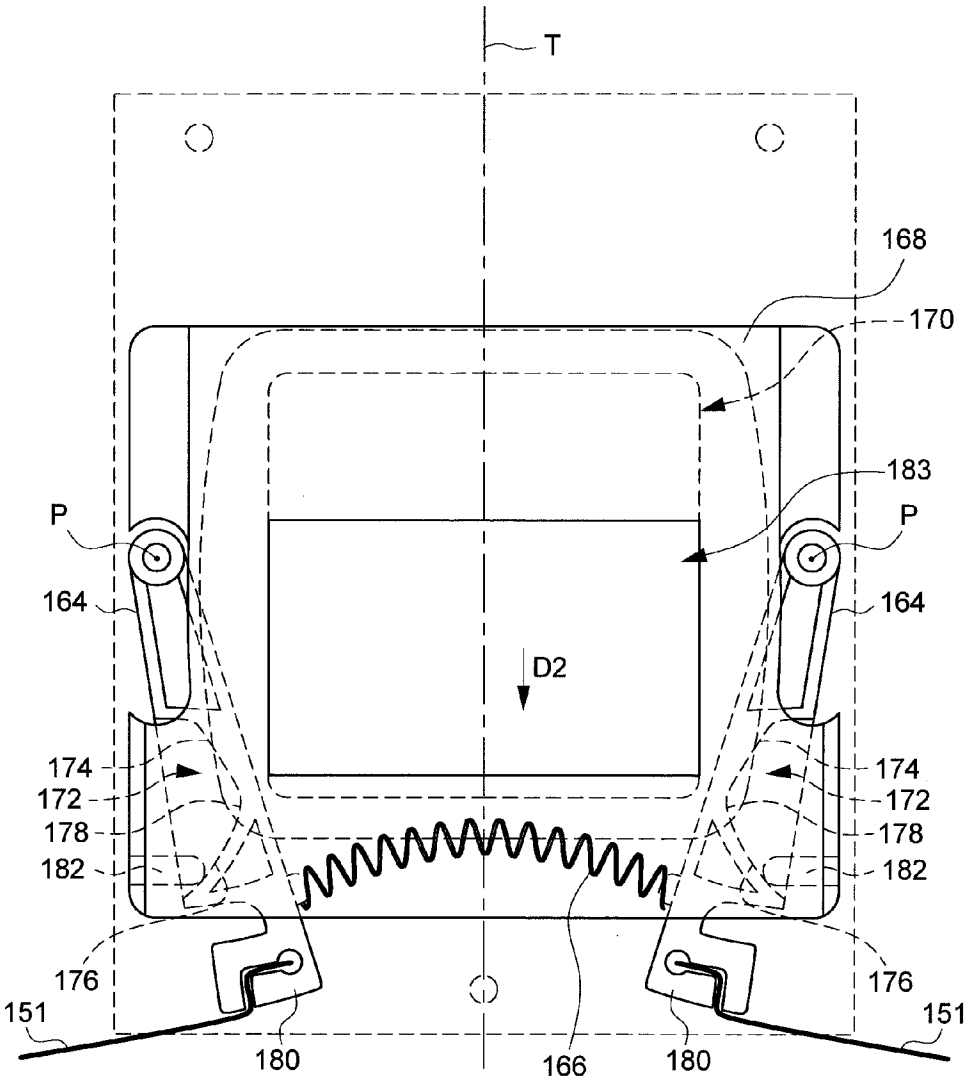
FIG. 18 is a schematic view illustrating the release mechanism operated in a second direction opposite to the first direction.

Referring to FIG. 18, when the release actuator 168 is actuated to slide in an opposite second direction D2 (e.g., downward) away from the rest position, the two protrusions 182 can respectively slide in contact with the ramp surfaces 176 away from the joint regions 178, which can urge the two release rockers 164 to likewise rotate toward each other and compress the spring 166. As a result, the release rockers 164 can respectively pull on the cables 151, which in turn respectively pull the rockers 142 in rotation to drive unlocking displacements of the latches 152 in the two latch mechanisms 130 like described previously.

With the aforementioned construction, the respective sliding contact between the release actuator 168 and the two release rockers 164 can be set along two symmetric paths arranged so that a displacement of the release actuator 168 away from the rest position in either of two opposite directions always drives likewise rotation of the release rockers 164 for unlocking the two latch mechanisms 130. Regardless the position of the infant resting support 104, the release actuator 168 thus can always be conveniently operated for unlocking the latch mechanisms 130. For example, when the infant resting support 104 is in the first position with the bearing surface BS1 facing upward, or in the second position with the bearing surface BS2 facing upward, a vertically upward or downward displacement of the release actuator 168 can likewise switch the latch mechanisms 130 from the locking state to the unlocking state.

Figure 19:
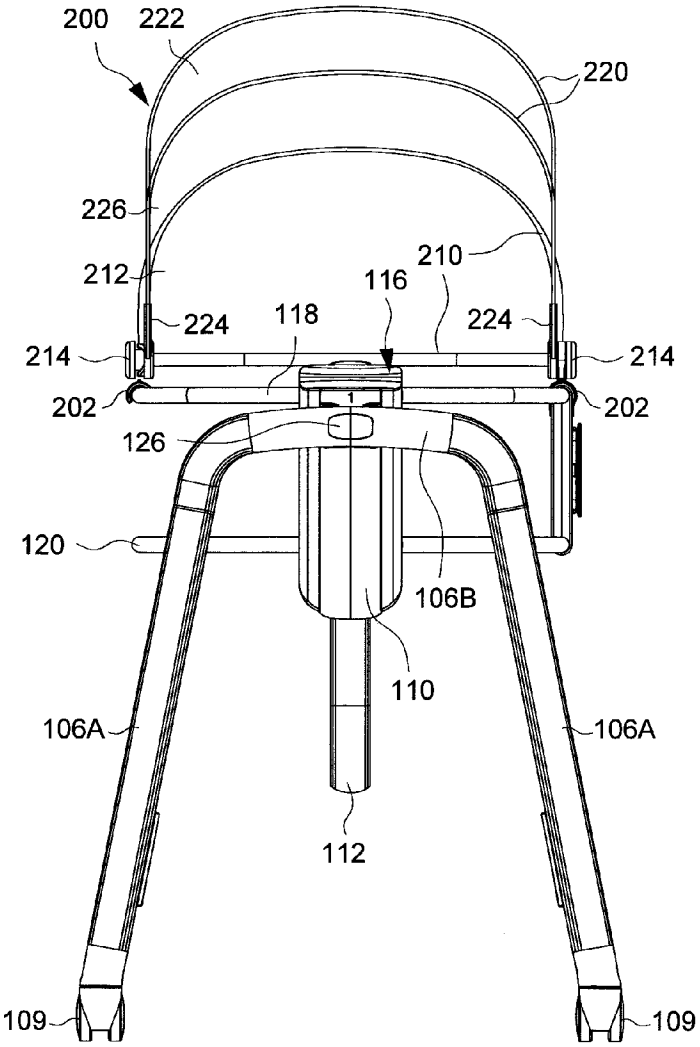
FIG. 19 is a schematic view illustrating the infant care apparatus mounted with a canopy accessory.
Figure 20:
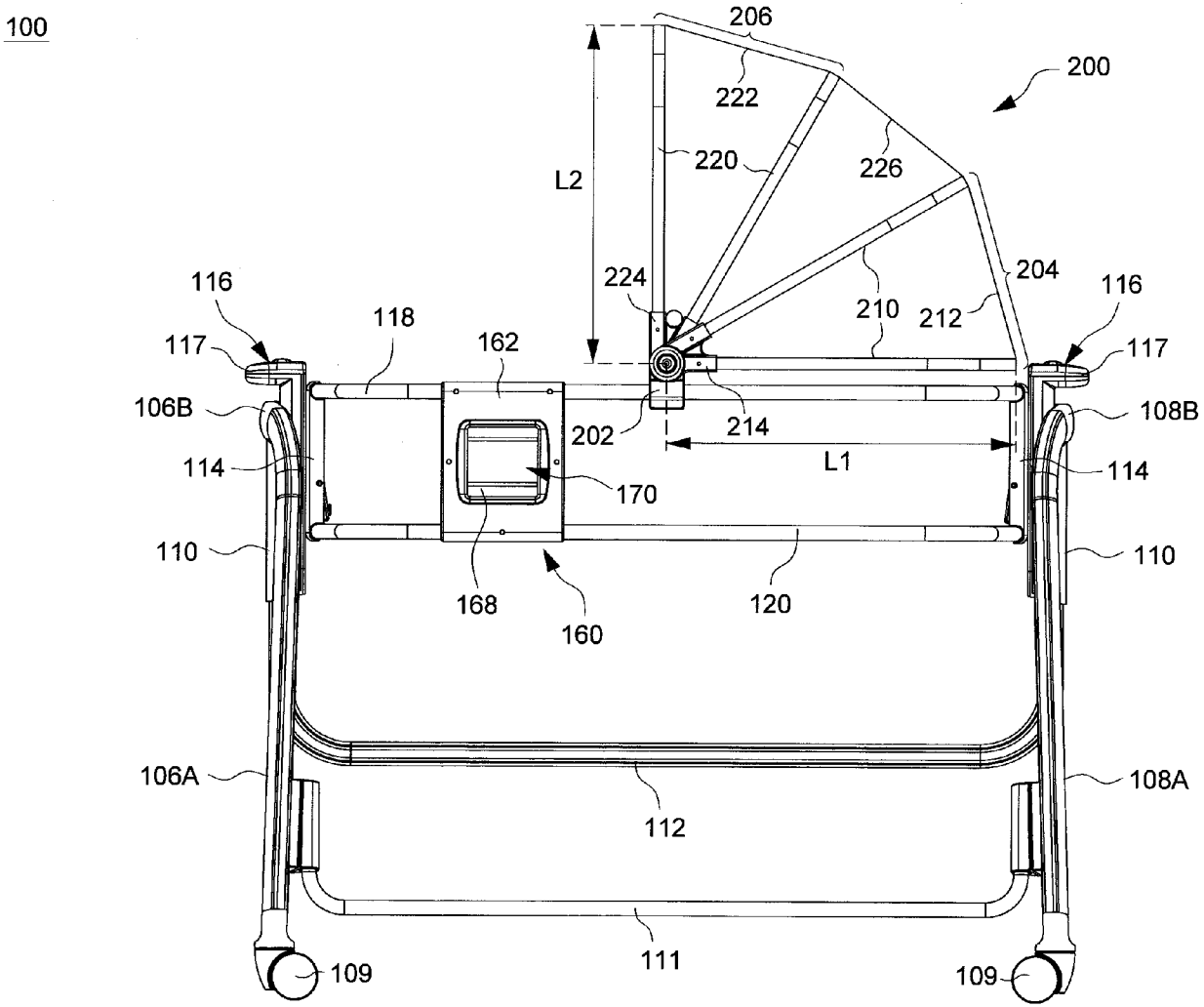
FIG. 20 is a schematic view illustrating the canopy accessory adjusted to a first position for shading a head area.
Figure 21:
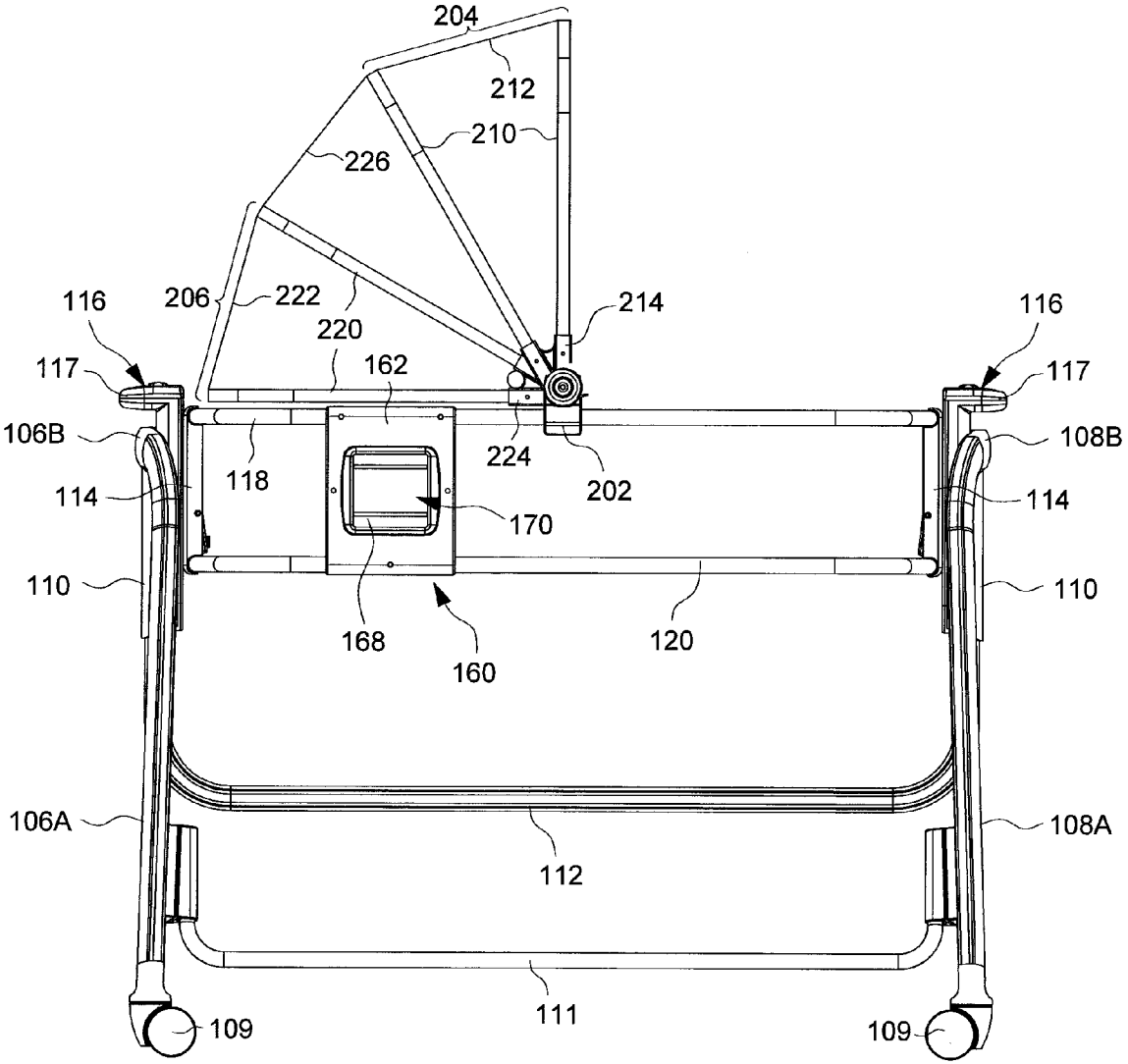
FIG. 21 is a schematic view illustrating the canopy accessory adjusted to a second position for shading a foot area.

FIGS. 19-21 are schematic views illustrating the infant care apparatus 100 mounted with a canopy accessory 200. The canopy accessory 200 can be installed on the infant resting support 104 of the infant care apparatus 100 while it is in the bassinet configuration. The canopy accessory 200 can include two fixtures 202 that can attach to two opposite sides of the infant resting support 104, and an outer and an inner bow assembly 204 and 206 that are pivotally connected with the two fixtures 202. The outer bow assembly 204 can include two bows 210, and an outer canopy panel 212 connected with the two bows 210. At each side, the two bows 210 are respectively affixed with a pivotal hub 214 that is pivotally connected with one fixture 202.

The inner bow assembly 206 can include two other bows 220, and an inner canopy panel 222 connected with the two bows 220. The bows 220 of the inner bow assembly 206 can have a radial length L2 that is smaller than the radial length L1 of the bows 210 of the outer bow assembly 204. The radial length L1 is the radial distance between the pivot axis of the outer bow assembly 204 and the farthest point of one bow 210, and the radial length L2 is the radial distance between the pivot axis of the inner bow assembly 206 and the farthest point of one bow 220. At each side, the two bows 220 are respectively affixed with a pivotal hub 224 that is pivotally arranged at an inner side of the pivotal hub 214. An intermediate canopy panel 226 can be further connected with one bow 210 of the outer bow assembly 204 and one bow 220 of the inner bow assembly 206.

The canopy accessory 200 can be pivotally adjusted relative to the fixtures 202 between a first state shown in FIG. 20 to cover a first end of the infant resting support 104 (e.g., corresponding to a head area), and a second state shown in FIG. 21 to cover an opposite second end of the infant resting support 104 (e.g., corresponding to a foot area). In the first state shown in FIG. 20, the outer bow assembly 204 can be placed adjacent to one side of the upper rail of the infant resting support 104, and the inner bow assembly 206 can be positioned to extend generally upright. In the second state shown in FIG. 21, the inner bow assembly 206 can be placed adjacent to the other opposite side of the upper rail of the infant resting support 104, and the outer bow assembly 204 can be positioned to extend generally upright. Accordingly, the canopy accessory 200 can be adjustable within a coverage range that is equal to 180 degrees.

Figure 22:
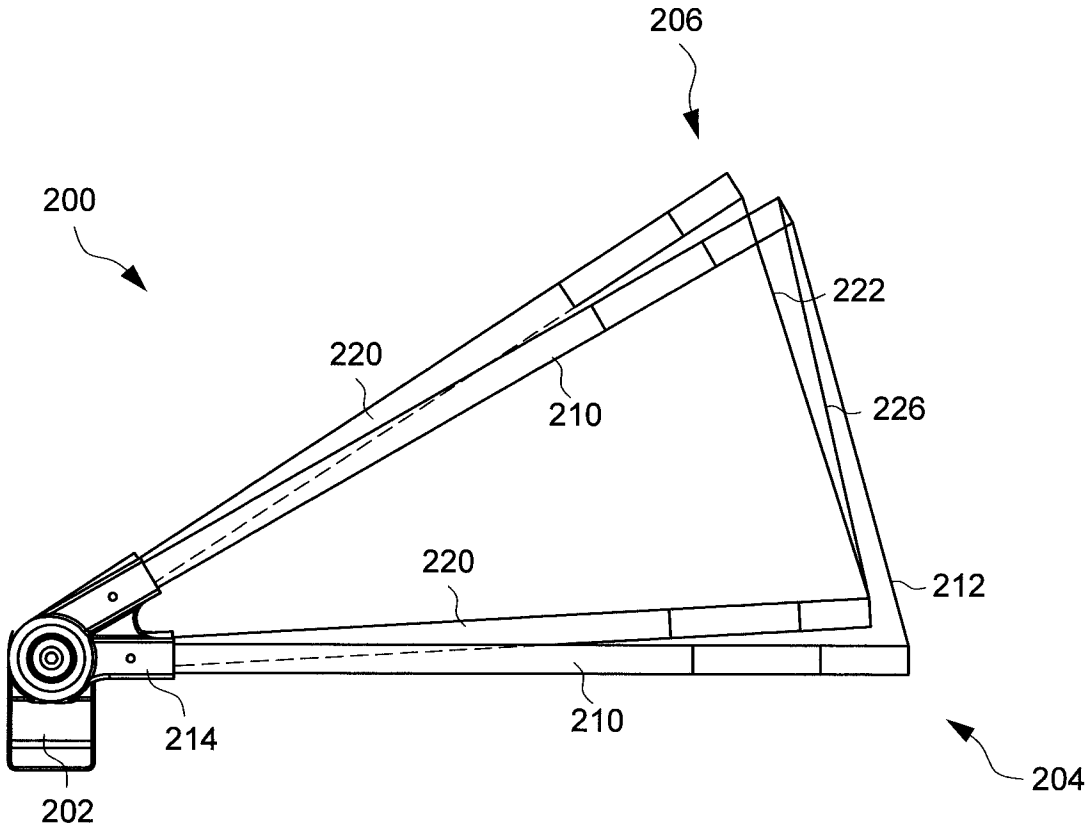
FIG. 22 is a schematic view illustrating the canopy accessory in a collapsed state.

Referring to FIG. 22, the inner bow assembly 206 can also be conveniently collapsed toward the outer bow assembly 204 so that the inner canopy panel 222 and the intermediate canopy panel 226 are received inside the outer bow assembly 204, the intermediate canopy panel 226 being arranged between the outer canopy panel 212 and the inner canopy panel 222. The canopy accessory 200 can be disposed near the foot or head area of the infant resting support 104 in the collapsed state.

Figure 23:
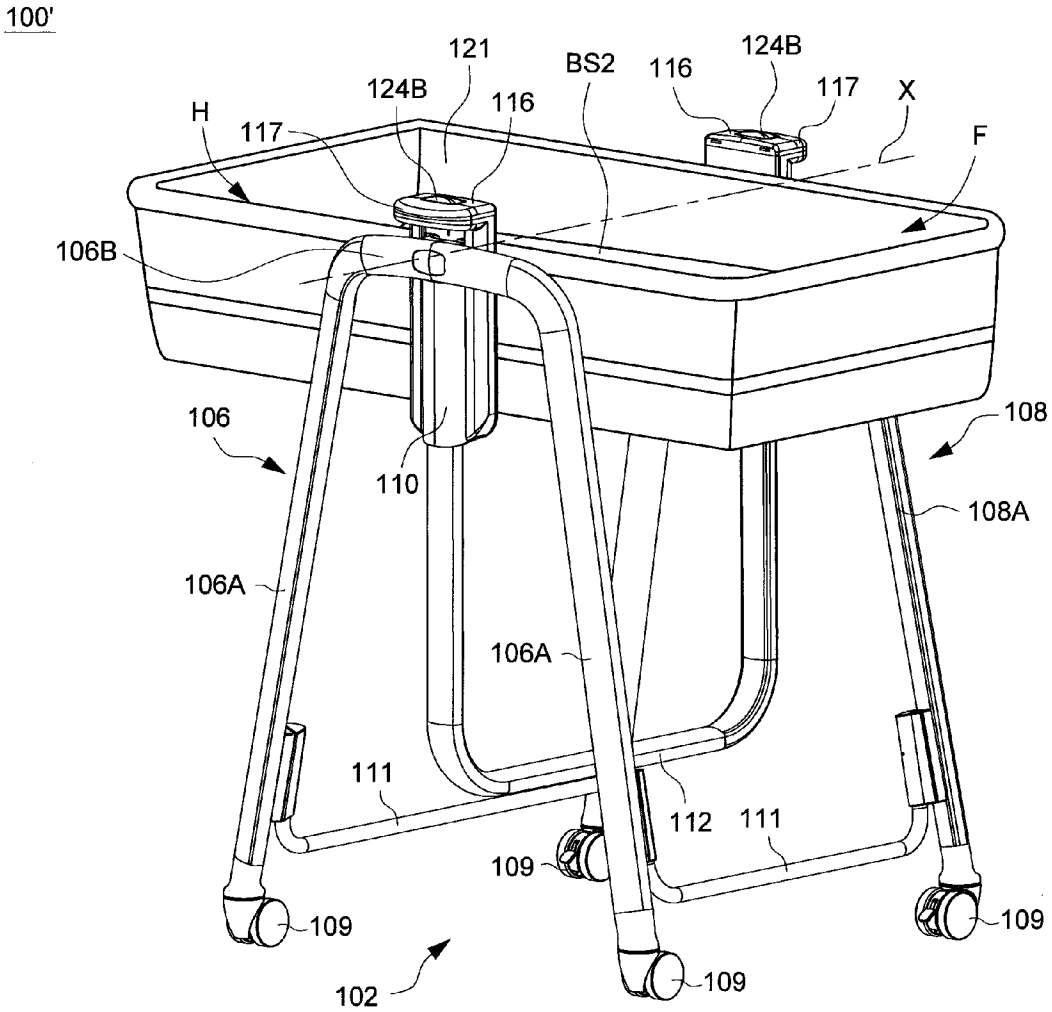
FIG. 23 is a schematic view illustrating a variant embodiment of an infant care apparatus.

It will be appreciated that multiple variations of the infant care apparatus 100 described previously may be possible. FIG. 23 is a schematic view illustrating a variant embodiment of an infant care apparatus 100'. The infant care apparatus 100' is substantially similar to the infant care apparatus 100, and can have a reversible infant resting support 104 that is vertically adjustable. The difference is that the two connections between the infant resting support 104 and the two leg frames 106 and 108 can be respectively arranged at two lateral sides (i.e., a left and right side) of the infant resting support 104, rather than at the foot and head area. As a result, the pivot axis X of the infant resting support 104 is transversal to a lengthwise axis L extending from the foot area F to the head area H of the infant resting support.

Advantages of the infant care apparatuses described herein include the ability to provide an infant resting support that is reversible and vertically adjustable to offer convenient and flexible use. In particular, the infant resting support can have at least a changer configuration and a bassinet configuration, both of which is vertically adjustable to adapt to a caregiver's height.

Realizations of the infant care apparatus have been described in the context of particular embodiments. These embodiments are meant to be illustrative and not limiting. Many variations, modifications, additions, and improvements are possible. These and other variations, modifications, additions, and improvements may fall within the scope of the inventions as defined in the claims that follow.

What is claimed is:

1. An infant care apparatus comprising:

a standing frame having an upper end portion and affixed with a bracket;

an infant resting support connected with the standing frame and having a plurality of bearing surfaces oriented in different directions, the infant resting support being affixed with a rotary hub that is movable vertically along the bracket, and each of the bearing surfaces when facing upward being configured to receive and support a child thereon;

a latch connected with the infant resting support, the latch being operable to rotationally lock the infant resting support with respect to the standing frame; and a vertical lock mechanism configured to lock the infant resting support at a desirable vertical position relative to the standing frame;

wherein the infant resting support is rotatable relative to the standing frame to selectively position one of the bearing surfaces facing upward for receiving a child thereon when the latch is unlocked, and the infant resting support is further slidable vertically relative to the standing frame to adjust a height of the infant resting support when the vertical lock mechanism is unlocked, the infant resting support being adjustable to at least a position higher than the upper end portion of the standing frame.

2. The infant care apparatus according to claim 1, wherein the infant resting support is adjustable to different vertical positions near the upper end portion of the standing frame.

3. The infant care apparatus according to claim 1, wherein the infant resting support has a foot area and a head area, the infant resting support being pivotally connected with the standing frame respectively near the foot and head area.

4. The infant care apparatus according to claim 1, wherein the infant resting support is pivotally connected with the standing frame about a pivot axis that is transversal relative to a lengthwise axis extending from a foot area to a head area of the infant resting support.

5. The infant care apparatus according to claim 1, wherein the latch is configured to rotationally lock the infant resting support in a first or a second position, a first one of the bearing surfaces facing upward when the infant resting support is in the first position, and a second one of the bearing surfaces facing upward when the infant resting support is in the second position.

6. The infant care apparatus according to claim 1, wherein the bracket is arranged adjacent to the upper end portion of the standing frame.

7. The infant care apparatus according to claim 6, wherein the standing frame includes two legs connected with each other at the upper end portion, and the bracket extends downward from the upper end portion in a region between the two legs.

8. The infant care apparatus according to claim 1, further including an adjusting member slidably connected with the bracket for vertical displacement, the adjusting member and the infant resting support being vertically adjustable relative to the standing frame, and the rotary hub being pivotally connected with the adjusting member.

9. The infant care apparatus according to claim 8, wherein the vertical lock mechanism includes a release member assembled with the adjusting member, the release member being operable to switch the vertical lock mechanism from a locking state to an unlocking state.

10. The infant care apparatus according to claim 9, wherein the latch is connected with the rotary hub, the latch engaging with the adjusting member to rotationally lock the infant resting support, and the latch disengaging from the adjusting member to allow rotation of the infant resting support relative to the standing frame.

11. The infant care apparatus according to claim 8, wherein the latch is connected with the rotary hub, the latch engaging with the adjusting member to rotationally lock the infant resting support with the standing frame, and the latch disengaging from the adjusting member to allow rotation of the infant resting support relative to the standing frame.

12. The infant care apparatus according to claim 1, wherein the rotary hub has a front surface, and the latch includes a hub cover that is affixed with two locking projections and is pivotally connected with the rotary hub behind the front surface about a first pivot axis, the hub cover being spring-biased to cause the two locking projections to respectively extend outward at the front surface to effect a locking engagement.

13. The infant care apparatus according to claim 12, wherein the rotary hub is further pivotally assembled with a rocker about a second pivot axis, the rocker being arranged between the front surface and the hub cover and having a driving surface in sliding contact with the hub cover at a location eccentric from the first pivot axis, the rocker being operable to rotate in a first direction for driving rotation of the hub cover in an unlocking direction.

14. The infant care apparatus according to claim 13, wherein the rocker further has a stop surface, the driving surface and the stop surface are disposed at two sides of the first pivot axis, the rocker being spring-biased in a second direction opposite to the first direction to cause an engaging contact between the stop surface and the hub cover for blocking rotation of the latch in the unlocking direction.

15. The infant care apparatus according to claim 13, further including a cable that connects the rocker to a release mechanism, the release mechanism being operable to drive rotation of the rocker in the first direction.

16. The infant care apparatus according to claim 13, wherein the second pivot axis is substantially orthogonal to the first pivot axis and parallel to a rotation axis of the infant resting support relative to the standing frame.

17. The infant care apparatus according to claim 1, wherein the bearing surfaces include a first and a second bearing surface, the infant resting support is in a changer configuration when the first bearing surface faces upward, and in a bassinet configuration when the second bearing surface faces upward.

18. The infant care apparatus according to claim 1, wherein the infant resting support is installed with a canopy accessory, the canopy accessory being adjustable to cover either of a foot area and a head area of the infant resting support.

19. An infant care apparatus comprising:

a standing frame;

an infant resting support connected with the standing frame and having a first and a second bearing surface oriented in different directions, each of the first and second bearing surfaces when facing upward being configured to receive and support a child thereon, the infant resting support being rotatable relative to the standing frame to selectively position only one of the first and second bearing surface facing upward;

a latch mechanism configured to rotationally lock the infant resting support in a first or a second position with respect to the standing frame, the first bearing surface facing upward when the infant resting support is locked in the first position, and the second bearing surface facing upward when the infant resting support is locked in the second position; and a release mechanism including a release actuator operatively connected with the latch mechanism, wherein the release actuator is operable to slide in either of a first and a second direction opposite to each other to switch the latch mechanism from a locking state to an unlocking state.

20. The infant care apparatus according to claim 19, wherein the release mechanism further includes:

a housing affixed with the infant resting support;

a release rocker pivotally connected with the housing about a pivot axis that is substantially orthogonal to an axis of displacement of the release actuator, the release rocker being spring-biased to remain in sliding contact with the release actuator;

wherein the release actuator has a rest position, and the sliding contact between the release actuator and the release rocker is set along a path arranged so that a displacement of the release actuator away from the rest position in either of the first and second direction drives rotation of the release rocker in a same direction for unlocking the latch mechanism.

21. The infant care apparatus according to claim 20, wherein the release mechanism further includes a cable having one end connected with the release rocker, a displacement of the release actuator away from the rest position in either of the first and second direction drives the release rocker in rotation to pull on the cable for unlocking the latch mechanism.

22. The infant care apparatus according to claim 20, wherein the infant resting support includes two rigid frame portions arranged parallel and offset with respect to each other, the housing being affixed with the two rigid frame portions, and the release actuator being arranged between the two rigid frame portions.

23. The infant care apparatus according to claim 20, wherein the release rocker has a first and a second ramp surface, and the release actuator has a protrusion, the protrusion sliding in contact with the first ramp surface as the release actuator slides in the first direction away from the rest position, and the protrusion sliding in contact with the second ramp surface as the release actuator slides in the second direction away from the rest position.

24. The infant care apparatus according to claim 19, wherein the infant resting support is pivotally connected with the standing frame about a pivot axis, and the release actuator is arranged at a position offset to one side of the pivot axis.

25. The infant care apparatus according to claim 19, wherein when the infant resting support is in the first or second position, the release actuator is operable to slide vertically in either of the first and second direction to switch the latch from a locking state to an unlocking state.

* * * * *